US010962337B2

(12) United States Patent
Leibushor et al.

(10) Patent No.: US 10,962,337 B2
(45) Date of Patent: Mar. 30, 2021

(54) CARTRIDGE FOR PROVIDING DELAYED CHAFF FOR USE AS A DECOY FOR RF RADARS

(71) Applicant: IMI SYSTEMS LTD., Ramat Hasharon (IL)

(72) Inventors: Eran Leibushor, Ramat Hasharon (IL); Roman Sondik, Ramat Hasharon (IL); Yaniv-Haim Gur, Ramat Hasharon (IL)

(73) Assignee: IMI SYSTEMS LTD., Ramat Hasharon (IL)

( * ) Notice: Subject to any disclaimer, the term of this patent is extended or adjusted under 35 U.S.C. 154(b) by 0 days.

(21) Appl. No.: 16/655,691

(22) Filed: Oct. 17, 2019

(65) Prior Publication Data

US 2021/0063126 A1 Mar. 4, 2021

(30) Foreign Application Priority Data

Sep. 3, 2019 (IL) ..... 269088

(51) Int. Cl.
*F42B 5/15* (2006.01)
*F42B 12/70* (2006.01)

(52) U.S. Cl.
CPC ..... *F42B 5/15* (2013.01); *F42B 12/70* (2013.01)

(58) Field of Classification Search
CPC ..... F42B 5/15; F42B 12/70
USPC ..... 102/436, 342, 357, 505
See application file for complete search history.

(56) References Cited

U.S. PATENT DOCUMENTS

| | | | | |
|---|---|---|---|---|
| 3,626,415 | A | 12/1971 | Montgomery | |
| 3,724,380 | A * | 4/1973 | Simmons | F42B 30/003 102/342 |
| 3,741,125 | A | 6/1973 | La Pointe | |
| 3,765,336 | A | 10/1973 | Kulsik | |
| 4,129,078 | A | 12/1978 | Schneider, Jr. et al. | |
| 4,134,115 | A | 1/1979 | Strom et al. | |
| 4,374,494 | A * | 2/1983 | Maury | F42B 12/70 102/357 |
| 8,763,533 | B2 * | 7/2014 | Prelic | F41J 2/02 102/336 |

FOREIGN PATENT DOCUMENTS

| | | |
|---|---|---|
| DE | 299753 | 5/1992 |
| EP | 0246368 | 11/1987 |
| FR | 2436363 | 4/1980 |
| GB | 1605462 | 12/2009 |
| GB | 2505721 | 3/2014 |

OTHER PUBLICATIONS

Office action for IL Patent Application No. 269088, dated Jun. 7, 2020.

* cited by examiner

*Primary Examiner* — Reginald S Tillman, Jr.
(74) *Attorney, Agent, or Firm* — Pearl Cohen Zedek Latzer Baratz LLP

(57) ABSTRACT

A delayed chaff cartridge for use as a decoy for RF radars may include a hollow longitudinal cartridge; one or more hollow capsules; and a propelling element configured to dispatch the capsule out from the hollow cartridge, wherein each hollow capsule includes: two longitudinal parts connected at second end via a pivot, and wherein, at least one of the two longitudinal parts is truncated at a first end.

16 Claims, 4 Drawing Sheets

CARTRIDGE FOR PROVIDING DELAYED CHAFF FOR USE AS A DECOY FOR RF RADARS

CROSS-REFERENCE TO RELATED APPLICATION

This application claims priority from Israeli Patent Application No. 269088, filed on Sep. 3, 2019.

FIELD OF THE INVENTION

The present invention generally relates to a chaff cartridge for use as a decoy for RF radars. More particularly, the present invention relates to a delayed chaff cartridge for use as a decoy for RF radars.

BACKGROUND OF THE INVENTION

Chaff cartridges are elements that are configured to carry and spread decoy material (e.g., chaff) to form a radar countermeasure. The spread decoy material forms a cloud of small, thin pieces of metal, metallized glass fiber and the like, which cloud appears as a cluster of primary targets on radar screens or swamps the screen with multiple returns, for example, in order to distract radar-guided missiles from their targets.

Modern chaff cartridge includes a hollow longitudinal container, a chaff payload (e.g., chaff fibers) and a propelling unit, also known as, a squib/impulse cartridge/propellant/pyrotechnic charger, for ejecting the chaff payload out from the hollow cartridge. The chaff fibers are packed and cut into dipoles ranging in length from 3 mm to over 60 mm. The chaff payload is ejected from the chaff cartridge, and thus from the aircraft/marine-vessel, immediately.

In order to increase the efficiency of the radar's decoy and to prevent aircraft contamination from chaff fibers, it is required to delay the spreading of the chaff fibers from the chaff cartridge. Therefore, a chaff cartridge with a delayed ejection/dispatching mechanism was developed.

SUMMARY OF THE INVENTION

Some aspects of the invention may be directed to a delayed chaff cartridge for use as a decoy for RF radars. In some embodiments, the delayed chaff cartridge may include: a hollow longitudinal cartridge; one or more hollow capsules; and a propelling element configured to dispatch the capsule out from the hollow cartridge. In some embodiments, each hollow capsule may include two longitudinal parts connected at second end via a pivot, and at least one of the two longitudinal parts may be truncated at a first end.

In some embodiments, both longitudinal parts may be truncated at the first end. In some embodiments, the hollow longitudinal cartridge may be made from a polymer. In some embodiments, the two longitudinal parts may be made from a polymer. In some embodiments, the at least one longitudinal part may be truncated at an angle of between 10-80°. In some embodiments, the delayed chaff cartridge may further include chaff fibers held inside the one or more hollow capsules.

In some embodiments, the delayed chaff cartridge may further include a cover that covers the first end of the two longitudinal parts. In some embodiments, the propelling element may include at least one of: a squib and a piston. In some embodiments, one hollow capsule from the one or more hollow capsules may further include a piston. In some embodiments, the truncated first ends of the one or more hollow capsules may be facing the propelling element. In some embodiments, the second ends, comprising the pivots, of the one or more hollow capsules may be facing the propelling element.

Some other aspects of the invention may be directed to a delayed chaff cartridge for use as a decoy for RF radars. In some embodiments, the delayed chaff cartridge may include: a hollow longitudinal cartridge; one or more hollow capsules; and a propelling element facing a first end of one hollow capsule and configured to dispatch the capsule out from the hollow cartridge. In some embodiments, each hollow capsule may include two or more longitudinal elements connected via weak bonds configured to disassemble the hollow capsule after dispatching.

In some embodiments, the hollow longitudinal cartridge may be made from a polymer. In some embodiments, the two or more longitudinal elements are made from a polymer. In some embodiments, the delayed chaff cartridge may further include chaff fibers held inside the one or more hollow capsules. In some embodiments, the propelling element comprises at least one of: squib and piston. In some embodiments, one hollow capsule from the one or more hollow capsules may further include a piston.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
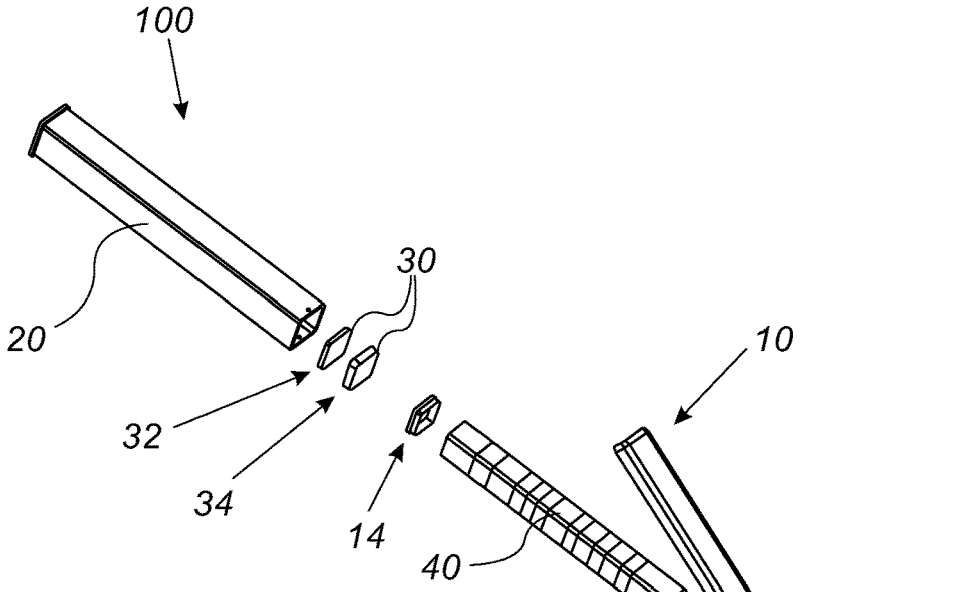
FIGS. 1A-1C are illustrations of delayed chaff cartridges according to some embodiments of the invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components, modules, units and/or circuits have not been described in detail so as not to obscure the invention. Some features or elements described with respect to one embodiment may be combined with features or elements described with respect to other embodiments. For the sake of clarity, discussion of same or similar features or elements may not be repeated.

Aspects of the invention may be directed to a delayed chaff cartridge for dispatching and spreading chaff fibers in the air. A delayed chaff cartridge according to some embodiments of the invention may be configured to spread the chaff fibers a predefined time after dispatching from the cartridge or at a predefined distance from the aircraft/marine-vessel due to a delaying mechanism. The delaying mechanism may include adding one or more capsules to hold the chaff fibers and be dispatched from the cartridge. The capsule may be designed to open in the air a predefined time from the dispatching or at predefined distance from the aircraft/marine-vessel.

Figure 1B:
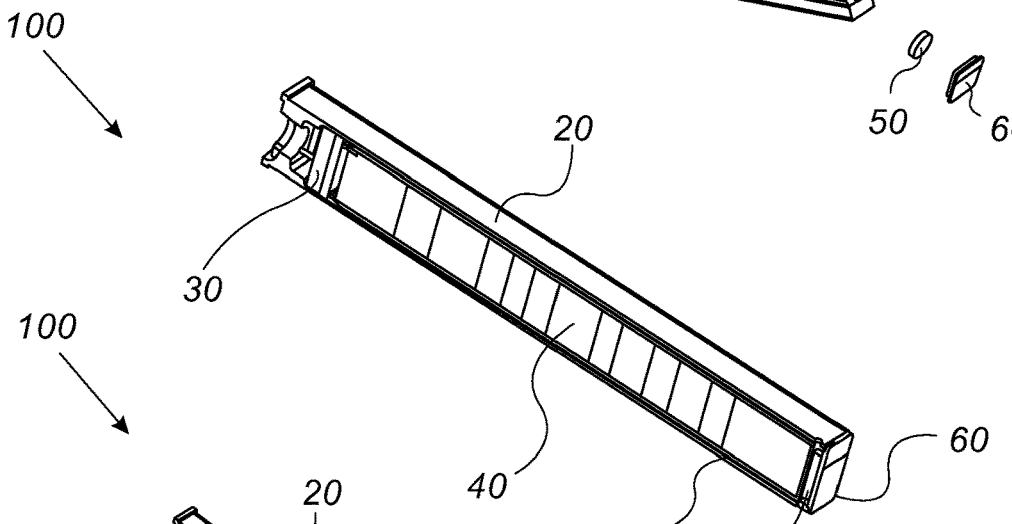
Figure 1C:
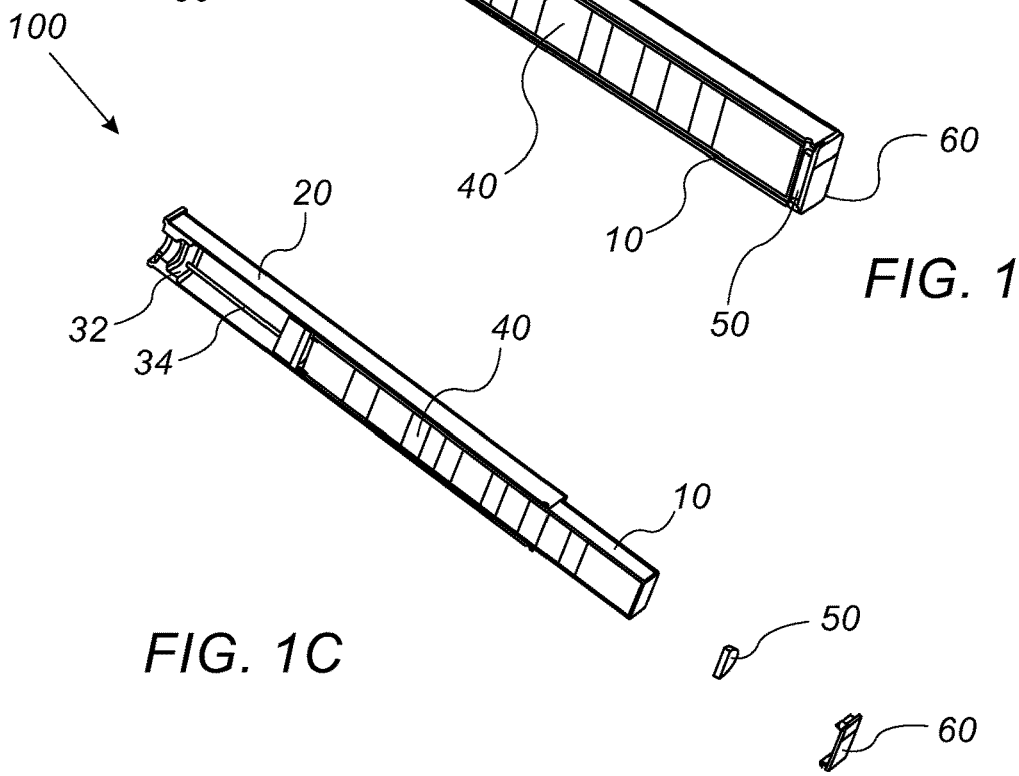

Reference is now made to FIGS. 1A-1C, which are illustrations of a delayed chaff cartridge for providing a delayed chaff as various dispatching stages according to some embodiments of the invention. A delayed chaff cartridge 100 may include a hollow longitudinal cartridge 20, and one or more hollow capsules 10 for holding chaff fibers 40, as illustrated in FIGS. 1B and 1C. In some embodiments, during assembly of delayed chaff cartridge 100, one or more hollow capsules 10 may be packed with chaff fibers 40 and may be inserted into longitudinal cartridge 20, as illustrated in FIG. 1C. In some embodiments, delayed chaff cartridge 100 may further include a propelling element 30 facing a first end of one hollow capsule 10 and configured to dispatch capsule 10 out from hollow cartridge 20. In some embodiments, each hollow longitudinal capsule 10 may include two longitudinal parts 11 and 12 connected at a second end via a pivot 13. In some embodiments, longitudinal parts 11 and 12 may be similar or different from each other.

In some embodiments, at least one of the two longitudinal parts 11 and 12 may be truncated at the first end (e.g., ends 11*a* and/or 12*a*, illustrated in FIG. 2A) facing propelling element 30. Detailed view of hollow capsule 10 is given in FIGS. 2A-2C discussed herein below.

In some embodiments, hollow longitudinal cartridge 20 may be made from any suitable material, for example, aluminum or a polymer, such as, Acrylonitrile butadiene styrene (ABS), nylon, polypropylene, polyethylene, epoxy resin and the like. In some embodiments, hollow longitudinal cartridge 20 may have any cross-section geometry, for example, a circle, a square, a rectangle, a hexagon and the like, and the invention, as a whole, is not limited to the illustrated square cross-section.

In some embodiments, propelling element 30 may include one of: a squib 34 and a piston 32. Squib 34 may include any propellant material/pyrotechnic charging material configured to explode or expands and push and dispatch capsule 10 out from hollow cartridge 20. Squib 34 may explode or expands in the vicinity of piston 32, thus pushing piston 32 to eject or dispatch one or more capsules 10. In some embodiments, squib 34 may be located between capsule 10 and piston 32. In some embodiments, piston 32 may be a separate standalone part or may be integrated part of capsule 10.

In some embodiments, cartridge 100 may include chaff fibers 40 held inside one or more hollow capsules 10. Chaff fibers 40 may be any suitable conductive fibers, for example, metal fibers, glass fibers coated by metallic coating (e.g., aluminum), carbon fibers and the like. Chaff fibers 40 may be packed/wrapped inside and cut into dipoles ranging in length from 3 mm to over 60 mm. In some embodiments, several different cuts having different lengths and dipoles may be held in a single hollow capsule 10. The selection of chaff cuts and dipoles may be conducted based on the radar the chaff should decoy.

In some embodiments, upon dispatching from longitudinal hollow cartridge 20, one or more capsules 10 may be delayed before opening, and thus the spreading of chaff fibers 40 held inside one or more capsules 10 may also be delayed. In some embodiments, the truncated structure of one or more capsules 10 may cause the delay in opening, as discussed herein below.

Figure 2A:
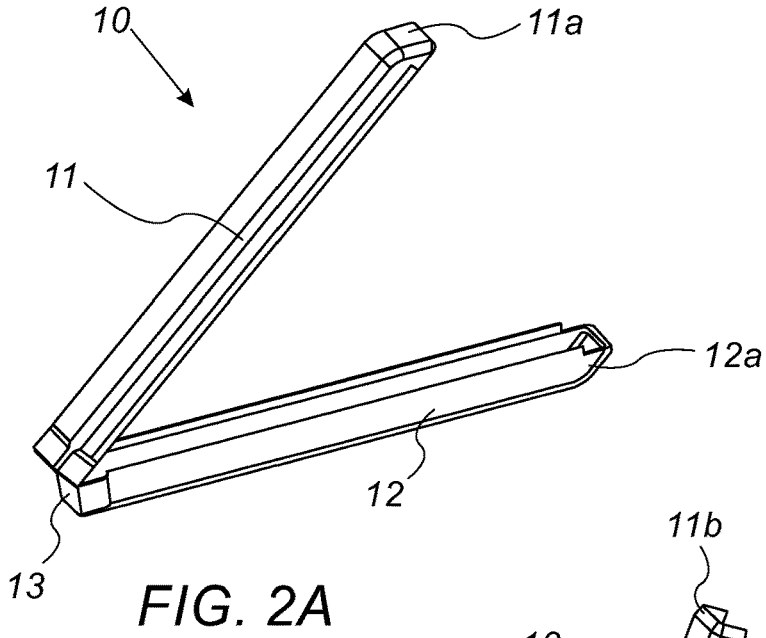
FIGS. 2A-2C are illustrations of hollow capsules for chaff cartridges according to some embodiments of the invention.
Figure 2B:
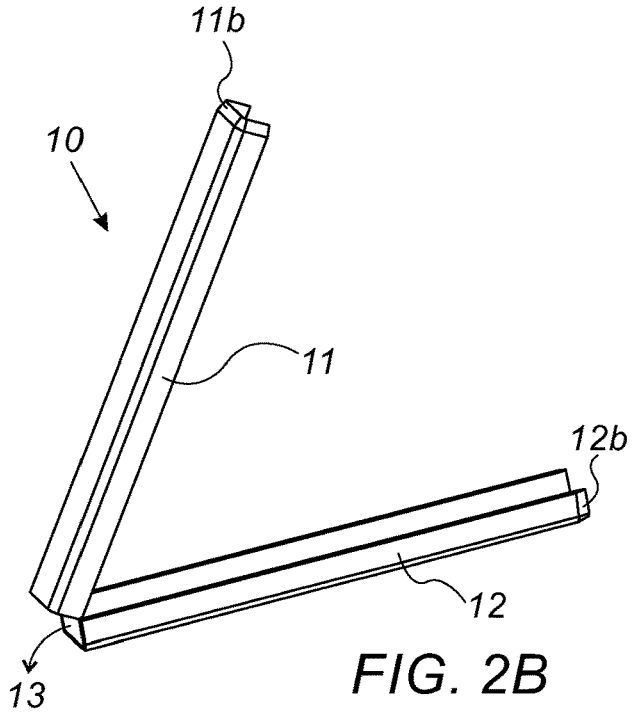
Figure 2C:
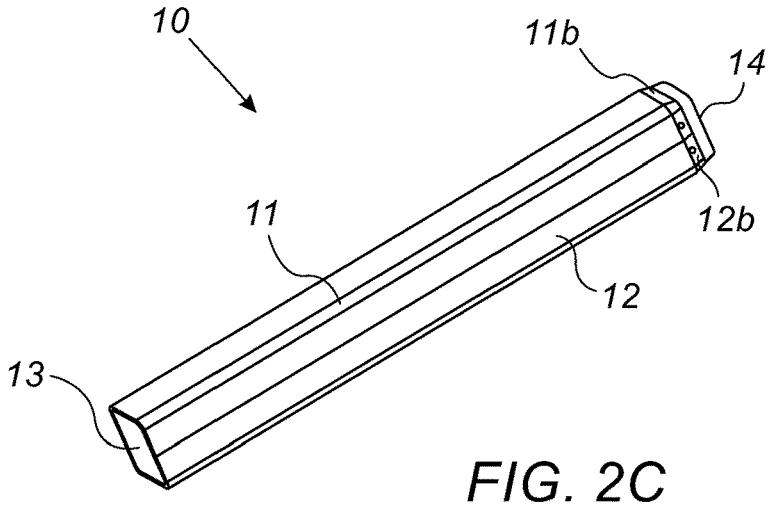

Reference is now made to FIGS. 2A-2C, which are illustrations of hollow capsules 10 for a delayed chaff cartridge 100 according to some embodiments of the invention. In some embodiments, each capsule 10 may include two longitudinal parts 11 and 12 connected at second end via a pivot 13. Pivot 13 may be any pivot, for example, a metal rod, a metal sheet and the like, connecting two longitudinal parts 11 and 12. Pivot 13 may be a structure included in two longitudinal parts 11 and 12, for example, when two longitudinal parts 11 and 12 are extruded, injection molded, or cast. Such a pivot may include two elements, wherein at least one of the elements is configured to be at least partially pivotally inserted into the other.

In some embodiments, at least one of the two longitudinal parts 11 and/or 12 may be truncated at first end 11*a*, 11*b*, 11*c*. In some embodiments, when capsule 10 may be configured to be launched from the back side of a moving platform (e.g., an airplane) against the progression direction of the moving platform, the truncated first end may be facing propelling element 30 (as illustrated and discussed with respect to FIG. 5A). In some embodiments, when capsule 10 may be configured to be launched from the front side of the platform in the progression direction, the second end that includes pivot 13 may be facing propelling element 30 (as illustrated and discussed with respect to FIG. 5B). In some embodiments, the truncation may force a delay in the opening of capsule 10, due to the wind acting on capsule 10 during the dispatching. The wind may push longitudinal parts 11 and 12 against each other. In some embodiments, both longitudinal parts 11 and 12 may be truncated at first ends 11*a*, 11*b*, 11*c*, 12*a*, 12*b*, 12*c*. In some embodiments, elements 11 and/or 12 may be truncated at various different angles between 10°-80° (with respect to a longitudinal axis of cartridge 100), for example, 45° (as illustrated in FIGS. 2A and 2C), 60° (as illustrated in FIG. 2B), 30°, 20°, 50°, 70° and the like. In some embodiments, the higher the angle is, the higher are the forces acting on elements 11 and 12, and, therefore, the longer may be the delay in the opening of capsule 10.

In some embodiments, two longitudinal parts 11 and 12 may be made from any suitable material, for example, from a polymer, such as, Acrylonitrile butadiene styrene (ABS), nylon, polypropylene, polyethylene, epoxy resin and the like.

In some embodiments, a cover 14, illustrated in FIG. 2C, may cover the first end of the two longitudinal parts 11 and 12, for example, truncated ends 11*c* and 12*c*. In some embodiments, cover 14 may add an additional delay to the opening of capsule 10 and/or may help to keep chaff fibers 40 inside capsule 10 after dispatching. In some embodiments, cover 14 may be attached to the end of the two longitudinal parts 11 and 12 without any additional connecting elements. In some embodiments, cover 14 may be connected to the end of the two longitudinal parts 11 and 12 by a connecting element, such as, a pin or a snap.

Figure 3:
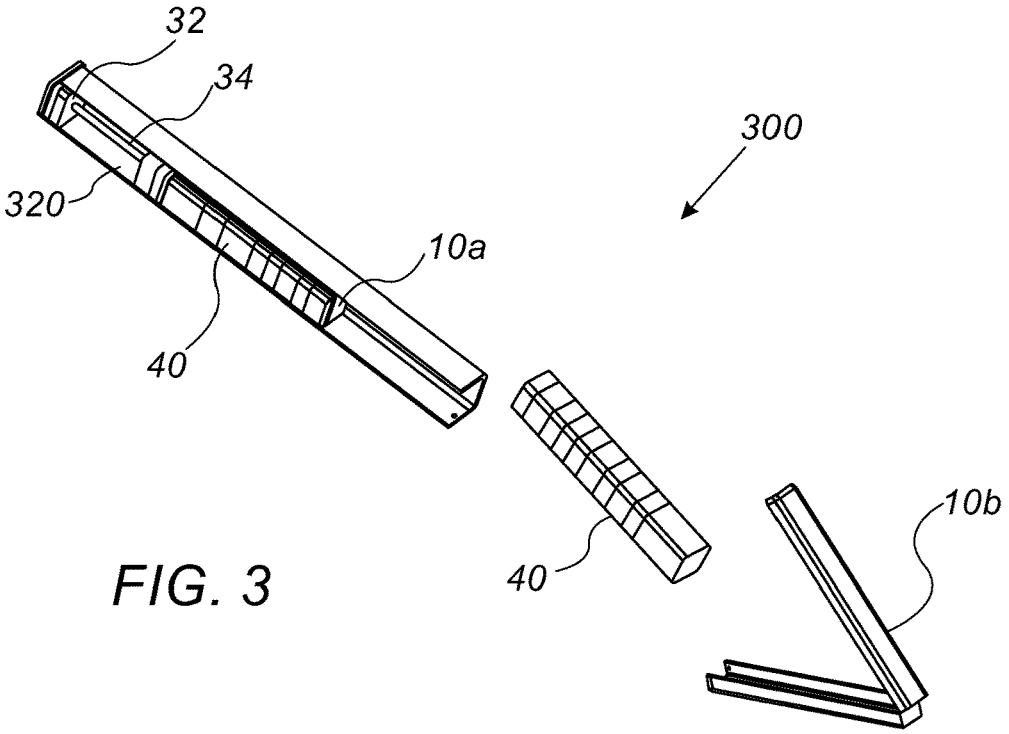
FIG. 3 is an illustration of a delayed chaff cartridge according to some embodiments of the invention.

Reference is now made to FIG. 3, which is an illustration of a delayed chaff cartridge according to some embodiments of the invention. A delayed chaff cartridge 300 may include hollow longitudinal cartridge 20, substantially similar to hollow longitudinal cartridge 20 of delayed chaff cartridge 100 and a plurality (e.g., two or more) of hollow capsules, for example, the illustrated two hollow capsules 10*a* and 10*b*. The two hollow capsules are a non-limiting example, and any other number of hollow capsules is within the scope of the invention. In some embodiments, each of hollow capsules 10*a*, and 10*b* may include two longitudinal parts connected at the second end via pivots 13*a* and 13*b* respectively and may further be truncated at the first. In some embodiments, delayed chaff cartridge 300 may further include one propelling element 30 located adjacent to the first or the second end of a first longitudinal cartridge 10*a*. In some embodiments, when cartridge 300 is configured to be launched from the back side of a moving platform (e.g., an airplane), against the progression direction, the truncated first ends of hollow capsules 10*a* and 10*b* may be facing propelling element 30 (as illustrated in FIG. 3). In some embodiments, when cartridge 300 is configured to be launched from the front of the moving platform, in the progression direction, second ends that includes pivots 13*a* and 13*b* may be facing propelling element 30 (not illustrated). In some embodiments, each one of hollow capsules 10*a*, and 10*b* may hold chaff fibers 40, as disclosed herein above.

Figure 4A:
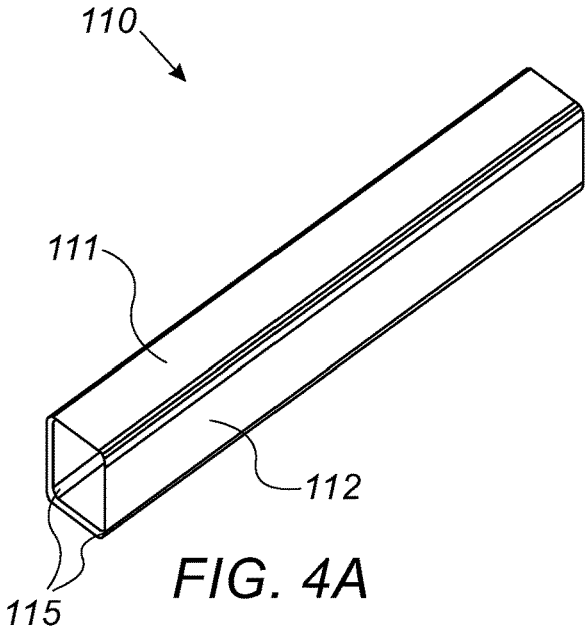
FIGS. 4A and 4B are side view and front view of a hollow capsule for a delayed chaff cartridge according to some embodiments of the invention.
Figure 4B:
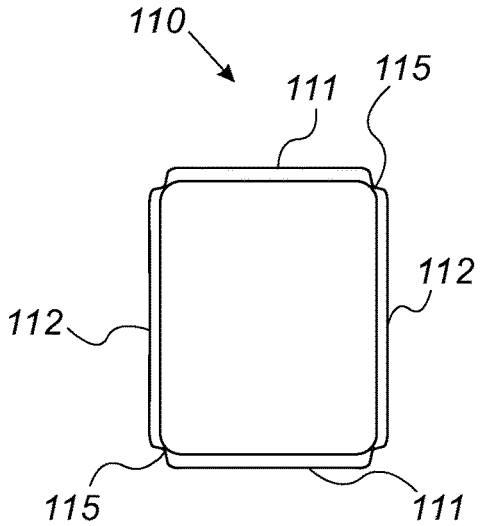

Reference is now made to FIGS. 4A and 4B, which are illustrations of a front and isometric views of a hollow capsule 110 to be included in a delayed chaff cartridge according to any embodiment of the invention, for example, delayed chaff cartridge 100 and/or 300. In some embodiments, one or more hollow capsules 110 included in the delayed chaff cartridge may be inserted (alone or in addition to hollow capsule 10) to hollow cartridge 20. In some embodiments, the delaying mechanism of hollow capsule 110 may include weak bonds 115 between at least two longitudinal elements 111 and 112 included in hollow capsule 110. In some embodiments, hollow capsule 110 may include four longitudinal elements 111 and 112 (as illustrated) bonded to form a rectangular hollow capsule via four weak bonds 115. Weak bonds 115 may be, for example, thinner joins, perforated joins, and the like In some embodiments, capsule 110 may have any cross-section geometry, for example, a circle, a square, a rectangle, a hexagon and the like and may be divided to any number of longitudinal elements, for example, two, three, four, five, six, or more.

In some embodiments, weak bonds 115 may be disassembled after the dispatching of capsule 110 from hollow cartridge 20, and thus may open capsule 110, thereby allowing chaff fibers 40 held inside capsule 110 to be spread in the air.

Figure 5A:
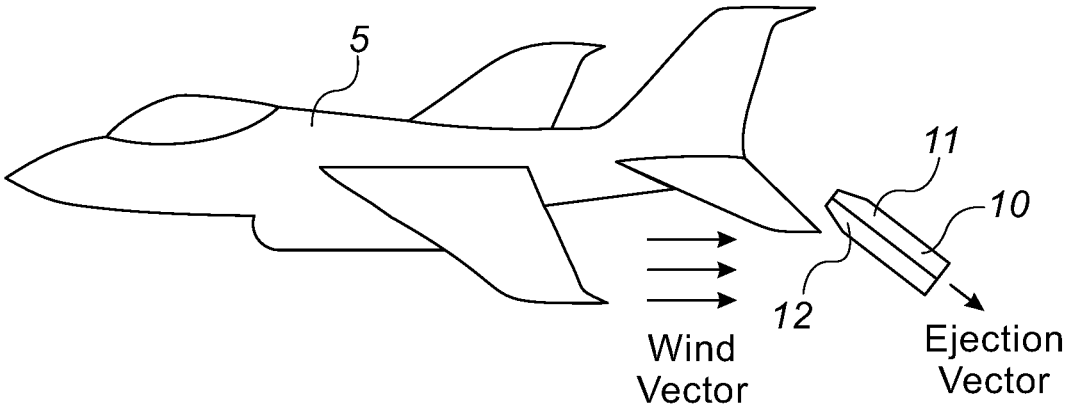
FIGS. 5A and 5B are illustrations of two optional ejections of a hollow capsule from the chaff cartridges when carried by an airplane according to some embodiments of the invention.
Figure 5B:
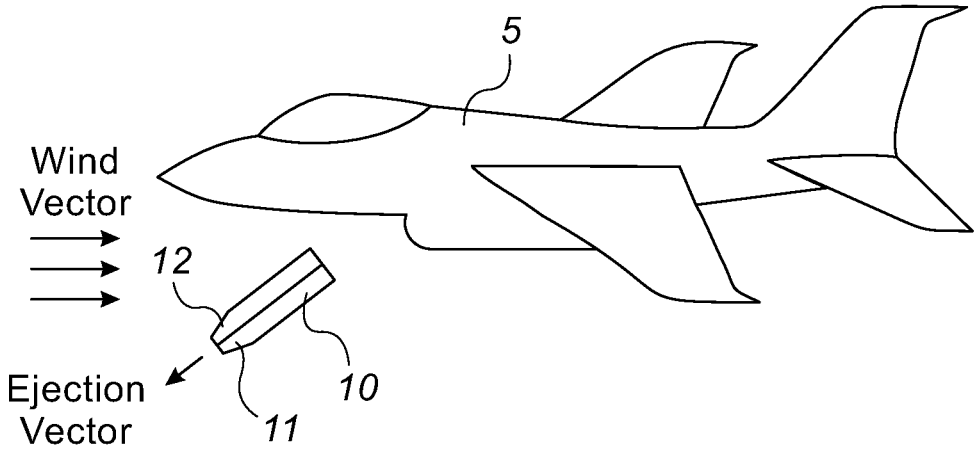

Reference is now made to FIGS. 5A and 5B, which are illustrations of two optional ejections of a hollow capsule from the chaff cartridges when carried by an airplane according to some embodiments of the invention. In some embodiments, the capsule (e.g., capsule 10) may be ejected from a moving platform 5 (e.g., an airplane) and dispatched from the hollow longitudinal cartridge (e.g., hollow longitudinal cartridge 20) against the progression direction of the moving platform 5, from the back of moving platform 5 as illustrated in FIG. 5A. The wind vector acting on the capsule has a direction opposite to the progression direction of the moving platform 5. Therefore, for the wind vector to delay the opening of capsule 10 by acting on truncated ends of longitudinal parts 11 and/or 12, capsule 10 may be ejected from hollow longitudinal cartridge 20, such that the truncated ends are the last part of capsule 10 to be dispatched, as illustrated. Therefore, capsule 10 may be inserted in hollow longitudinal cartridge 20 such that truncated first end 11 and/or 12 may be facing propelling element 30.

In some embodiments, the capsule (e.g., capsule 10) is ejected from a moving platform 5 (e.g., an airplane) and dispatched from the hollow longitudinal cartridge (e.g., hollow longitudinal cartridge 20) in the progression direction of the moving platform 5, from the front of moving platform 5 as illustrated in FIG. 5B. Therefore, for the wind vector to delay the opening of capsule 10 by acting on truncated ends of longitudinal parts 11 and/or 12, capsule 10 may be ejected from hollow longitudinal cartridge 20 such that the truncated ends are the first part of capsule 10 to be dispatched/ejected, as illustrated. Therefore, capsule 10 may be inserted in hollow longitudinal cartridge 20 such that second ends, comprising pivots 13, of the one or more hollow capsules 10 are facing propelling element 30.

In some embodiments, for the wind vector to apply closing force on the truncated ends of longitudinal parts 11 and/or 12, longitudinal parts 11 and/or 12 may be positioned in cartridge 20 as illustrated in FIGS. 5A and 5B. In some embodiments, capsule 10 may be located inside hollow longitudinal cartridge 20 such that, when capsule 10 is ejected from cartridge 20 (in all the disclosed configuration), the wider walls of two longitudinal parts 11 and 12 may face the ground. For example, when capsule 10 is still closed (after dispatching), the edges of longitudinal parts 11 and 12, attached to each other, may be located on the walls of two longitudinal parts 11 and 12 that are substantially perpendicular to the ground. In such configuration, a component of the wind vector, perpendicular to at least one truncated surface, may act to delay the opening of capsule 10.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

Various embodiments have been presented. Each of these embodiments may of course include features from other embodiments presented, and embodiments not specifically described may include various features described herein.

The invention claimed is:

1. A delayed chaff cartridge for use as a decoy for RE radars, comprising:
- a hollow longitudinal cartridge;
- one or more hollow capsules; and
- a propelling element configured to dispatch the capsule out from the hollow cartridge,
- wherein each hollow capsule comprises:
  - two longitudinal parts connected at second end via a pivot,
  - wherein at least one of the two longitudinal parts is truncated at a first end.

2. The delayed chaff cartridge of claim 1, wherein both longitudinal parts are truncated at the first end.

3. The delayed chaff cartridge of claim 1, wherein the hollow longitudinal cartridge is made from a polymer.

4. A delayed chaff cartridge according to claim 1, wherein the two longitudinal parts are made from a polymer.

5. A delayed chaff cartridge according to claim 1, wherein the at least one longitudinal part is truncated at an angle of between 10-80°.

6. A delayed chaff cartridge according to claim 1, further comprising chaff fibers held inside the one or more hollow capsules.

7. A delayed chaff cartridge according to claim 1, further comprising a cover that covers the first end of the two longitudinal parts.

8. A delayed chaff cartridge according to claim 1, wherein the propelling element comprises at least one of: a squib and a piston.

9. A delayed chaff cartridge according to claim 1, wherein one hollow capsule from the one or more hollow capsules further comprises a piston.

10. A delayed chaff cartridge according to claim 1, wherein the truncated first ends of the one or more hollow capsules are facing the propelling element.

11. A delayed chaff cartridge according to claim 1, wherein the second ends, comprising the pivots, of the one or more hollow capsules are facing the propelling element.

12. A delayed chaff cartridge for use as a decoy for RE radars, comprising:

a hollow longitudinal cartridge;

one or more hollow capsules; and a propelling element facing a first end of one hollow capsule and configured to dispatch the capsule out from the hollow cartridge, wherein each hollow capsule comprises two or more longitudinal elements, made from synthetic polymer, connected via weak bonds configured to disassemble the hollow capsule after dispatching.

13. A delayed chaff cartridge according to claim 12, wherein the hollow longitudinal cartridge is made from a polymer.

14. A delayed chaff cartridge according to claim 12, further comprising chaff fibers held inside the one or more hollow capsules.

15. A delayed chaff cartridge according to claim 12, wherein the propelling element comprises at least one of: squib and piston.

16. A delayed chaff cartridge according to claim 12, wherein one hollow capsule from the one or more hollow capsules further comprises a piston.

* * * * *